United States Patent [19]

Laméris

[11] Patent Number: 4,479,536

[45] Date of Patent: Oct. 30, 1984

[54] HEAT EXCHANGER FOR A GASEOUS AND A LIQUID MEDIUM

[75] Inventor: Herman J. Laméris, Hollandse Rading, Netherlands

[73] Assignee: Bronswerk K.A.B. B.V., Utrecht, Netherlands

[21] Appl. No.: 294,993

[22] Filed: Aug. 21, 1981

[30] Foreign Application Priority Data

Aug. 26, 1980 [NL] Netherlands ..... 8004805

[51] Int. Cl.[3] ..... F28F 9/22

[52] U.S. Cl. ..... 165/145; 165/157; 122/6 A

[58] Field of Search ..... 122/32, 33, 6 A, 511; 165/144, 145, 150, 157, 158, 159, 160; 122/7 A, 6 R

[56] References Cited

U.S. PATENT DOCUMENTS 673,767 5/1901 Eycleshymer .
2,938,712 4/1956 Pellmyr .
3,020,894 2/1962 Rowand .
3,134,430 5/1964 Heyn .
3,302,620 2/1967 Menzel .
3,814,062 6/1974 Vollhardt .
3,842,904 10/1974 Gardenier .
4,284,134 8/1981 Harris .

*Primary Examiner*—William R. Cline
*Assistant Examiner*—John F. McNally
*Attorney, Agent, or Firm*—Diller, Ramik & Wight

[57] ABSTRACT

A heat exchanger block includes a series of rows of tubes, the end rows of which are joined to form walls, and two further rows of tubes at the opposite sides of the series, also formed as walls. The tubes of the further rows are shorter than the other tubes and, at one side, are spaced downwardly from the top and, at the other side, are spaced upwardly from the bottom. A pair of lateral openings at the opposite sides and ends of the block results. The blocks may be joined to provide composites or they may be separate although joined at one pair of their lateral openings. A pressure vessel may enclose the blocks to relieve them of rupturing pressure.

11 Claims, 7 Drawing Figures

Figure 1:
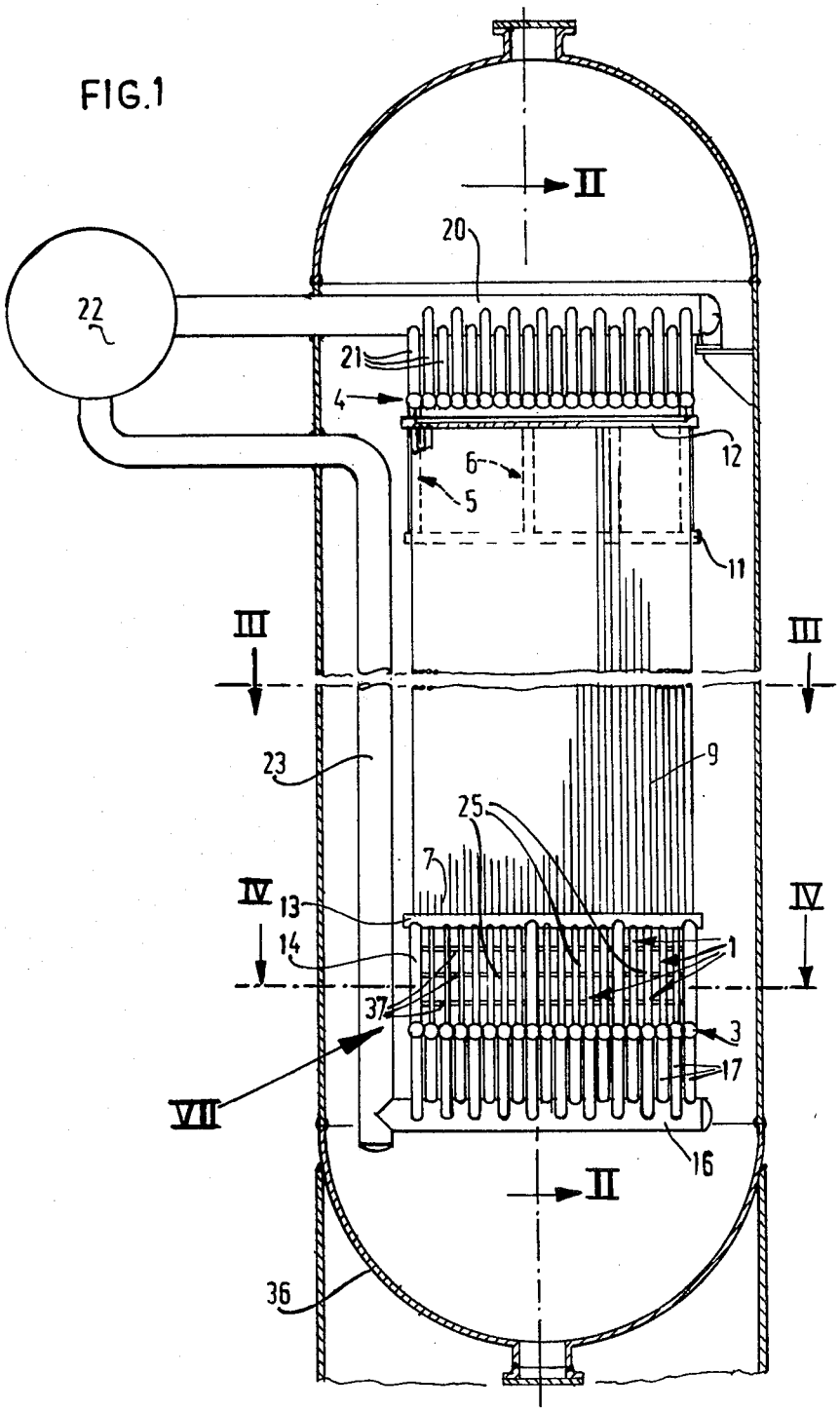

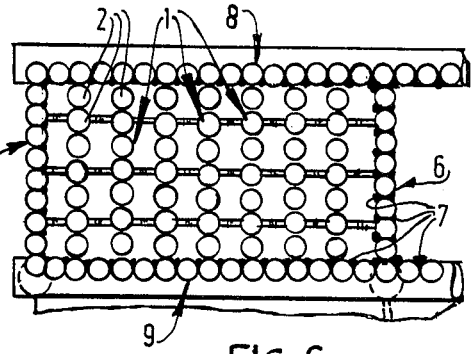
FIG.6
FIG.3
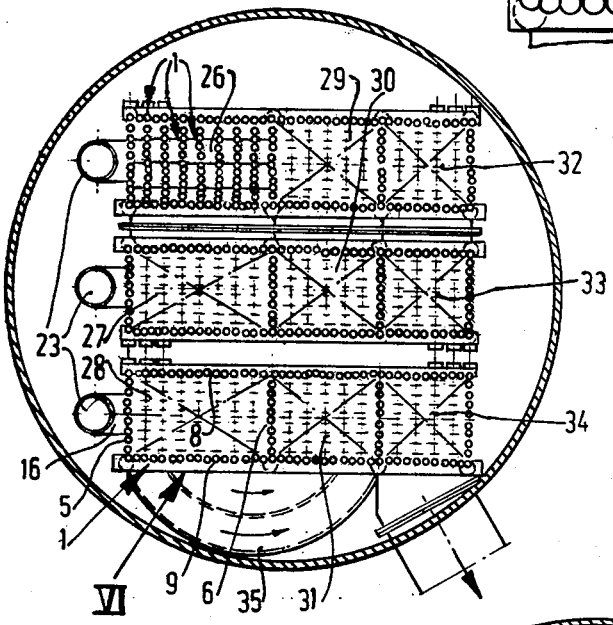
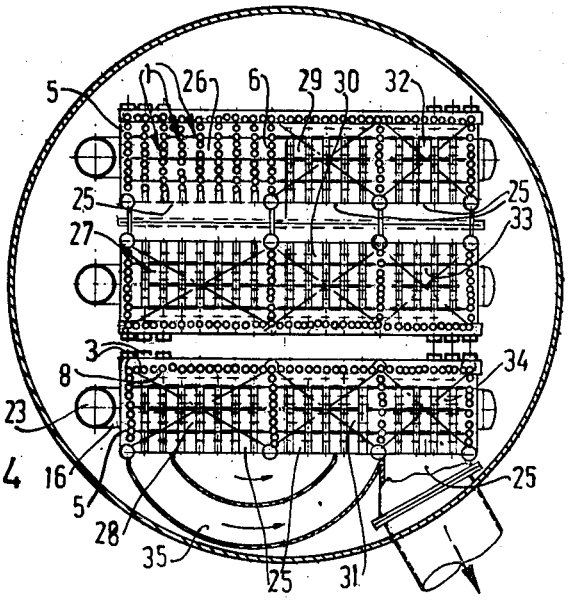
FIG.4

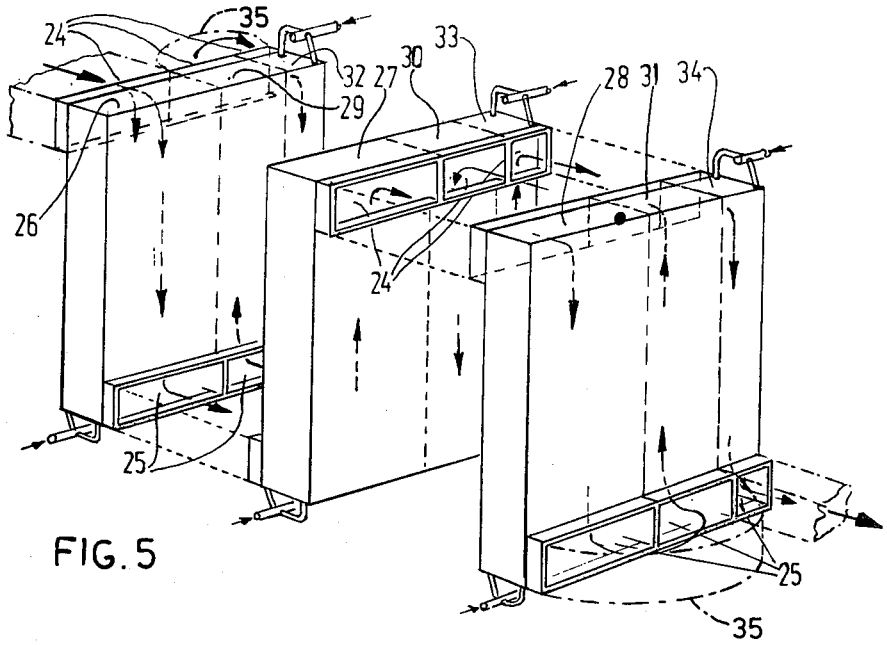
FIG. 5
FIG. 7
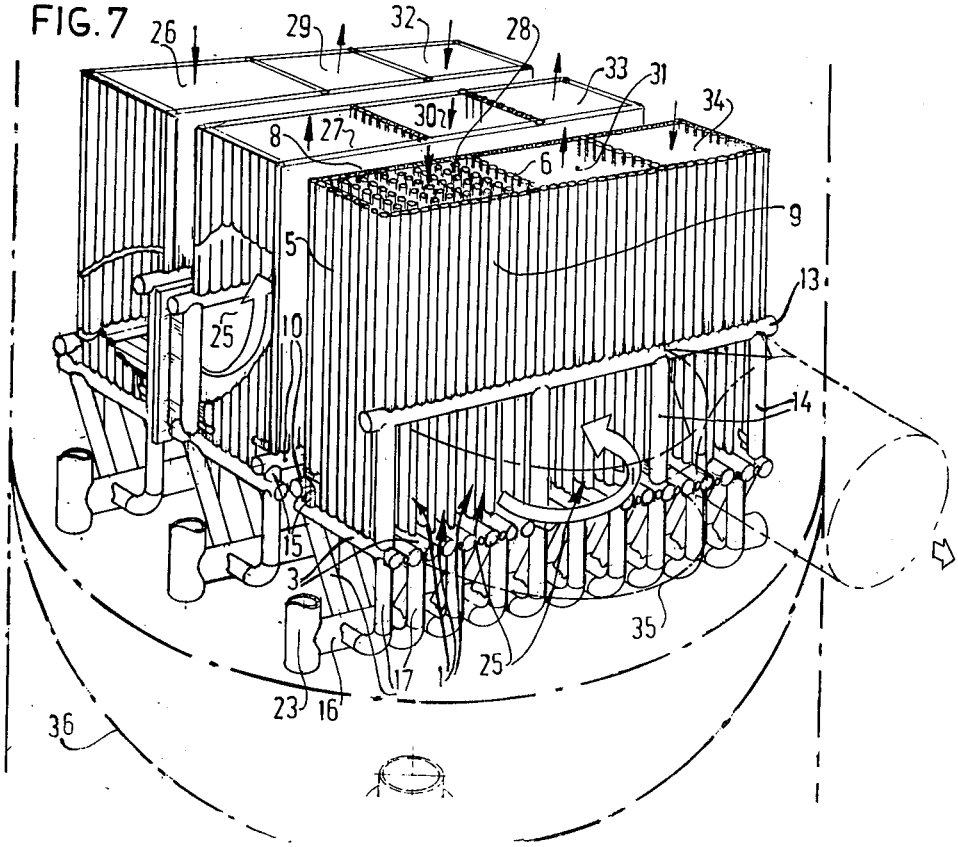

HEAT EXCHANGER FOR A GASEOUS AND A LIQUID MEDIUM

The invention relates to a heat exchanger for a gaseous and a liquid medium comprising one or more bundles of pipes connected with collectors having an inlet and an outlet for the fluid and a jacket bounding the space around the pipes having an inlet and an outlet for the gaseous medium.

The invention has for its object to provide such a heat exchanger which is suitable for a gaseous medium containing dust without involving inadmissible wear and fouling of the heat exchanger.

According to the invention the heat exchanger may comprise a plurality of blocks each built up from a plurality of pipe screens arranged side by side and each formed by a row of closely adjacent pipe adjoining on the lower and upper sides a collector, the outermost screens being constructed in the form of diaphram walls by means of connecting strips located between the pipes, peripheral screens being located at the edges of the pipe screens also constituted by diaphragm walls, each of which is formed by a row of vertical pipes communicating with intermediate collectors, each diaphragm wall being connected at the vertical edges in sealing relationship with the diaphragm walls adjacent the same and being orthogonal thereto, the collectors and the intermediate collectors being connected by connecting pipes with main collectors. The gases will flow in a vertical sense i.e. the direction of length of the pipes so that the risk of erosion and fouling is minimized. The structure is simple thanks to the pipe screens employed. The flow rate can be adjusted by the choice of the number of pipe screens, which can, moreover, be readily standardized, since their constructions may be identical. Since the blocks are bounded by diaphragm walls, these walls also take part in the heat exchange.

According to the invention the main collectors located on the lower side and the upper side may be interconnected by a down pipe located outside the block. Thus the down pipes are not heated so that natural circulation of the fluid through the pipes can be used.

According to the invention, in order to form inlet and outlet orifices for the gaseous medium, one peripheral screen may terminate at such a distance from the top side and the other peripheral screen at such a distance from the lower side that passages are formed in a vertical plane, where the rate in a direction at right angles to the pipes is sufficiently low to avoid wear. It is thus possible for the gas to flow at the ends in a horizontal direction between the pipe screens and to leave the space between the pipe screens in the same direction. This readily permits of arranging a plurality of blocks one behind the other. In order to obtain a closure of the space between the pipe screens also on the lower and upper sides, the collectors of a block located on the lower and top sides may, in accordance with the invention, be constructed in the form of diaphragm walls with the aid of strips arranged between said collectors.

According to the invention curved guide plates can be arranged near the bottom and top sides of a block between the screens, one end of said plates extending horizontally as far as into the passages and the other end extending vertically. This ensures a satisfactory guidance of the stream when entering and leaving the block.

According to the invention the diaphragm wall formed by collectors on the bottom side can have an orifice for allowing collected dust to pass. When dust is separated out at a bend of the stream, it is deposited on the diaphragm wall on the bottom side. Owing to said orifice the dust can be readily removed.

According to the invention a plurality of blocks may be united to form a set in which the orifice of a first block on the bottom side communicates with the corresponding orifice of the second block and the orifice of said second block on the top side can communicate with the orifice of a third block on the top side and so forth, the pipe screens and the associated collectors of the various blocks registering with one another. In this way a particularly simple and cheap structure of the heat exchanger can be obtained, whilst a high degree of standardization of the component parts can be carried out.

According to the invention a plurality of sets of blocks can be arranged side by side, in which the screen walls for two neighbouring blocks form a common wall and the peripheral screens of the neighbouring blocks are in line with one another and in which the outlet of one set communicates through a bent pipe with the inlet of the adjacent set. This enlarges the heat exchanging surface, whilst the construction remains compact.

In an effective embodiment of the invention, in the case of a plurality of adjacent sets of blocks, the blocks of each further set comprise fewer screens than the blocks of the preceding set, whilst the distance between the pipe screens is maintained. In a particularly simple manner it is thus ensured that the overall passage of a next-following set of blocks is smaller than that of the preceding set, it thus being avoided that due to cooling of the gas the rate of flow in a next-following set would decrease and thus adversely affect the heat transfer. According to the invention it is thus ensured in a simple manner to maintain the rate of flow in a heat exchanger at a satifactory level up to the end.

According to the invention a heat exchanger consisting of a plurality of blocks can be arranged in a pressure vessel. It is possible, with the aid of the simple construction of the blocks, to use high gas pressure. The pressure difference on the diaphragm walls will then not markedly exceed the value corresponding to the flow loss through the blocks. In the vessel the mean pressure of the gas may prevail.

When using such a pressure vessel, the inlet duct and the outlet duct of a fluid may be passed, in accordance with the invention, in close proximity of one another across the wall of the vessel. Thus problems involved in expansion differences are avoided.

The invention will be described more fully hereinafter with reference to an embodiment of a heat exchanger embodying the invention shown in the drawing.

Figure 2:
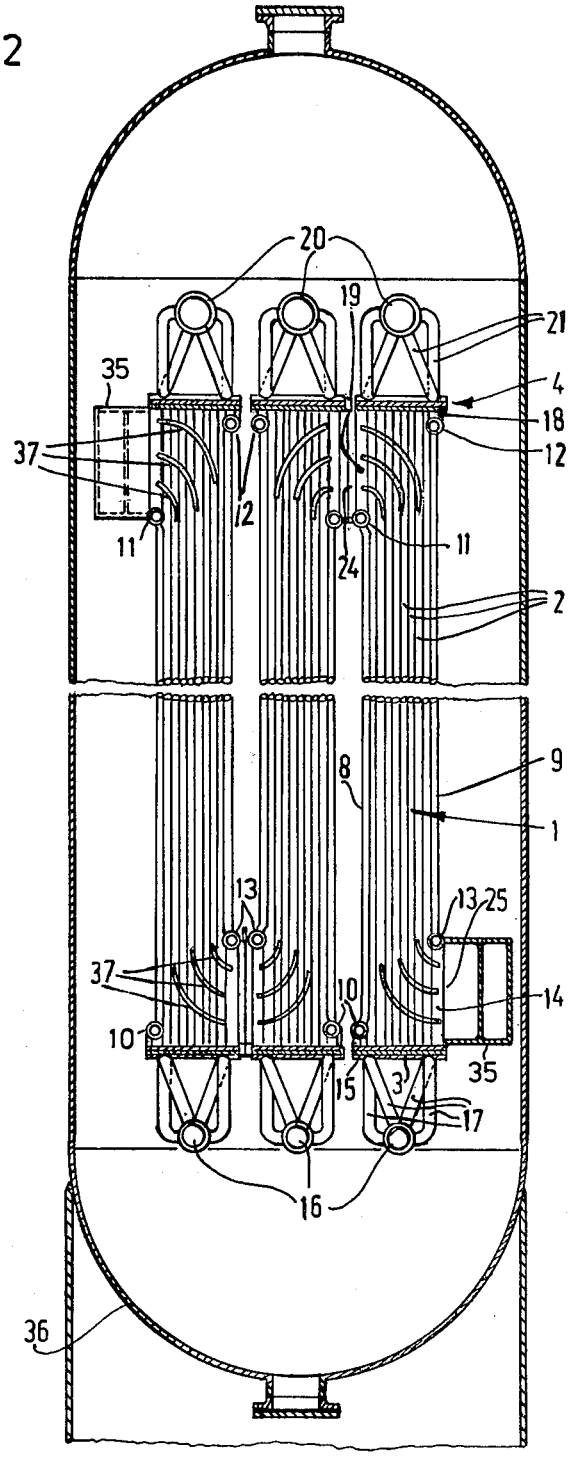

The drawing shows in:

FIG. 1 a vertical sectional view of a heat exchanger embodying the invention, FIG. 2 a sectional view taken on the line II—II of the heat exchanger of FIG. 1, FIG. 3 a sectional view taken on the line III—III of the heat exchanger of FIG. 1, FIG. 4 a sectional view taken on the line IV—IV of the heat exchanger of FIG. 1, FIG. 5 a schematic, perspective view of the structure of a heat exchanger formed by a plurality of blocks, FIG. 6 a detail of FIG. 3 on an enlarged scale, FIG. 7 perspective view of detail VII of FIG. 1.

The heat exchanger shown comprises pipes arranged in vertical screens 1. Each screen comprises pipes 2 closely arranged side by side and communicating on the bottom side with collectors 3 and on the top with collectors 4. As is shown by way of example in FIGS. 3 and 6, the outermost screen walls 5 and 6 are constructed in the form of diaphragm walls with the aid of tie pieces 7 located between the pipes and formed, for example, by strips or welds. At the ends of the pipe screens are located peripheral screens 8 and 9. These peripheral screens are also constructed in the form of rows of vertical pipes closely adjacent one another, the interstices being closed so that also in this case diaphragm walls are formed. On the bottom side the pipes of the peripheral screens open out in an intermediate collector 10 and on the top side in an intermediate collector 11. On the top side the pipes of the peripheral screens 9 open out in an intermediate collector 12 and on the bottom side in an intermediate collector 13. The intermediate collectors 10 and 13 communicate through connecting pipes 14 and 15 with the collectors 3. The collectors 3 communicate through connecting pipes 17 with the main collectors 16. At the top the intermediate collectors 11 and 12 communicate in a similar manner through connecting pipes 18 and 19 with collectors 4. The collectors 4 communicate through connecting pipes 21 with the main collectors 20. The main collectors 16, 20 having a drum 22 are interconnected by down pipes 23. Like the collectors 4 at the top, the collectors 3 are constructed on the bottom side in the form of diaphragm walls.

From FIG. 3 it will be apparent that every two pipe screens formed by diaphragm walls 5 and 6 and two peripheral screens 8 and 9 formed by diaphragm walls constitute a heat exchanger in the form of a block, which is bounded at the bottom and at the top by diaphragm walls formed by the collectors 3 and 4 respectively. At the edges the diaphragm walls are sealed to one another. Since the peripheral screen 8 terminates at the top in the collector 11 spaced apart from the collectors 4 and the peripheral screen 9 terminates at the bottom in a collector 13 spaced apart above the diaphragm wall formed by the collectors 3 an opening 24 is formed at the top and an opening 25 at the bottom. The heat exchanger shown is composed of a plurality of blocks each bounded by walls 5, 6, 8 and 9. FIG. 5 clearly shows how the blocks 26, 27 and 28 are arranged adjacent a series of blocks 29, 30 and 31, adjacent a further series 32, 33 and 34. The opening 24 of the block 26 at the top constitutes the inlet of the heat exchanger. The opening 25 of the block 26 at the bottom communicates by means of a short tie piece with flanges with the opening 25 of the block 27 at the bottom. The opening 24 of the block 27 communicates with the opening 24 of the block 28. The opening 25 of the block 28 communicates through an elbow pipe with the opening 25 of the block 31 at the bottom. In a similar manner the block 31 communicates with the block 30, which communicates in turn with the block 29. The outlet opening 24 of the block communicates through an elbow pipe with the opening 24 of the block 32. The blocks 32, 33 and 34 communicate in a similar manner, the opening 25 of the block 34 finally forming the outlet opening of the heat exchanger as a whole.

From FIGS. 3 and 4 it will be apparent that the pipe screens of the sets of blocks are in line with one another. This ensures a satisfactory transition of the stream from one block to the other. In the adjacent sets of blocks 26, 27, 28 and 29, 30, 31 and 32, 33, 34 the peripheral screens are in line with one another, whilst the screens 6 are common to the adjacent blocks. In this way a compact unit is formed and the capacity of the blocks can be adapted by choosing the number of screens. It will be obvious that with a limited number of types of pipe screens in conjunction with collectors and peripheral screens the choice of the number permits of designing a large number of heat exchangers of different capacities.

The drawing shows that the set of blocks 26, 27, 28 comprises more pipe screens 1 than the set of blocks 29, 30, 31, whilst the set of blocks 32, 33, 34 has the smallest number of screens. Thus the passage of the various sets of blocks gradually narrows. This means that despite cooling of the gases a satisfactory flow rate can be maintained. FIG. 2 shows that in the area of the inlet and outlet openings guide plates 37 may be arranged. These guide plates are at right angles to the pipe screen 1 and their edges are on one side horizontal in the communication openings and on the other side vertical inside the pipe screens. The diaphragm walls formed by the collectors 3 on the bottom side of each block may have an opening. Any dust falling down from the gases can thus be readily removed. To this end a gas-tight outlet device of known type may be employed. The heat exchanger comprising a plurality of blocks as shown is arranged in a pressure vessel 36.

This has the advantage that in the case of high gas pressure the diaphragm walls need not be strong to be capable of resisting such pressure. Up to a pressure of about 3 bars the heat exchanger could even stand free in space. It is then only necessary to arrange a few stiffening ribs around the blocks to absorb the forces.

If it is desired to employ higher pressures the pressure vessel can be used, in which the entire heat exchanger and the main collectors at the top can be accommodated. The inlet ducts for the medium passing through the pipes can be passed close to one another through the wall in order to avoid problems involved in expansion differences between pressure vessel and heat exchanger. For example, the outlet for the gaseous medium may be in open communication with the space inside the vessel. In designing the blocks it is then only necessary to take into account the pressure difference resulting from flow losses, whilst a given safety margin is observed.

I claim:

1. A heat exchanger block for transferring heat between a gas and a liquid, which comprises a series of rows of parallel, closely spaced tubes and two further rows of parallel, closely spaced tubes at the opposite sides of said series of rows and orthogonal thereto, filler means joining the tubes of the end rows of said series of rows and the tubes of said two further rows to provide gas impervious walls surrounding the remainder of said series of rows, the tubes of said two further rows being of less length than the tubes of said series of rows and the ends of the tubes forming one of said further rows being disposed closely adjacent one end of the block which the ends of the tubes forming the other of said further rows being disposed closely adjacent the other end of the block whereby lateral wall openings are provided at the opposite sides and ends of said block, first liquid collector means communicating one set of corresponding ends of all of said tubes exteriorally of said block and second liquid collector means communicating the other set of corresponding ends of all of said tubes exteriorally of said block, means for introducing gas into one of said lateral openings and means for collecting gas from the other of said lateral openings, and means for introducing liquid into said first liquid collector means while educting liquid through said second collector means.

2. A heat exchanger block as defined in claim 1 in combination with a second block, the first and second blocks sharing a common end row of said series of rows and said two further rows so that the combined blocks present two pairs of lateral openings at the opposite sides and ends of the two blocks.

3. A composite heat exchanger as defined in claim 2 wherein the spacing between the end rows of the first block is greater than the spacing between the end rows of the second block whereby the areas of the lateral openings of each pair are correspondingly different.

4. A heat exchanger block as defined in claim 1 in combination with a second heat exchanger block of identical form, the lateral openings of the two blocks which are adjacent one end thereof being directly communicated.

5. A composite heat exchanger as defined in claim 2 in combination with a second composite heat exchanger of identical form, the pair of lateral openings adjacent one end of the blocks of one composite being directly communicated with the corresponding lateral opening of the other composite.

6. A heat exchanger block as defined in claim 1 including a first set of curved plates extending from one of said lateral openings to divert incoming gas smoothly approximately 90 to flow parallel to said tubes, and a second set of curved plates extending to the other of said lateral openings to direct outgoing gas smoothly approximately 90 to discharge perpendicular to said tubes.

7. A heat exchanger block as defined in claim 1 wherein said tubes are vertical and said means for introducing and educting liquid comprises a vessel disposed at least at the level of the upper end of said block and communicating with said first collector means and a down pipe communicating said vessel and said second collector means.

8. A heat exchanger block as defined in claim 1 in combination with a closed pressure vessel enclosing said block, said means for introducing gas comprising a conduit discharging into the interior of said pressure vessel and thereby flowing into said one lateral opening, said means for collecting gas comprising a conduit connected with the other lateral opening and passing outwardly of the pressure vessel.

9. A heat exchanger block as defined in claim 1 in combination with a closed pressure vessel enclosing said block, said means for introducing liquid while educting liquid including a pair of pipes joined to and passing through said pressure vessel in closely spaced relation to each other so as to avoid problems involved in expansion differences between the pressure vessel and said block.

10. A heat exchanger as defined in claim 9 wherein said means for introducing liquid while educting liquid also includes a pipe within said pressure vessel extending parallel to said block and communicating between one of said pair of pipes and said second collector means.

11. A heat exchanger as defined in claim 10 wherein said tubes are vertical and including a liquid source vessel located exteriorily of said pressure vessel at least at the level of said first collector means and to which both pipes of said pair are connected.

* * * * *